US009585456B2

(12) United States Patent
Choi et al.

(10) Patent No.: US 9,585,456 B2
(45) Date of Patent: Mar. 7, 2017

(54) COSMETIC COMPOSITION CONTAINER COMPRISING FOAM

(71) Applicants: Jung Sun Choi, Yongin-si (KR); Kyung Ho Choi, Yongin-si (KR); Kyung Nam Kim, Yongin-si (KR)

(72) Inventors: Jung Sun Choi, Yongin-si (KR); Kyung Ho Choi, Yongin-si (KR); Kyung Nam Kim, Yongin-si (KR)

(73) Assignee: AMOREPACIFIC CORPORATION, Seoul (KR)

( * ) Notice: Subject to any disclaimer, the term of this patent is extended or adjusted under 35 U.S.C. 154(b) by 158 days.

(21) Appl. No.: 14/391,879

(22) PCT Filed: Apr. 12, 2013

(86) PCT No.: PCT/KR2013/003110
§ 371 (c)(1),
(2) Date: Oct. 10, 2014

(87) PCT Pub. No.: WO2013/154399
PCT Pub. Date: Oct. 17, 2013

(65) Prior Publication Data

US 2015/0078802 A1 Mar. 19, 2015

(30) Foreign Application Priority Data

Apr. 13, 2012 (KR) ..... 10-2012-0038615

(51) Int. Cl.
*A45D 34/04* (2006.01)
*A45D 37/00* (2006.01)

(52) U.S. Cl.
CPC ..... *A45D 34/04* (2013.01); *A45D 37/00* (2013.01); *A45D 2200/1018* (2013.01); *A45D 2200/1036* (2013.01)

(58) Field of Classification Search
CPC combination set(s) only.
See application file for complete search history.

(56) References Cited

U.S. PATENT DOCUMENTS

| | | | | |
|---|---|---|---|---|
| 5,904,151 | A * | 5/1999 | Gueret | A45D 40/00 132/293 |
| 6,688,317 | B2 | 2/2004 | Gueret | |
| 6,883,995 | B1 | 4/2005 | Gueret | |
| 7,811,021 | B2 | 10/2010 | Gueret | |
| 2002/0127046 | A1 | 9/2002 | Gueret | |
| 2005/0042018 | A1 | 2/2005 | Gueret | |
| 2009/0180826 | A1 | 7/2009 | Guay | |
| 2011/0014254 | A1 | 1/2011 | Choi et al. | |

FOREIGN PATENT DOCUMENTS

| | | | |
|---|---|---|---|
| EP | 1230869 | | 8/2002 |
| JP | 2000287746 | A | 10/2000 |
| JP | 200234648 | A | 2/2002 |
| JP | 2007508086 | A | 4/2007 |
| KR | 1020090100643 | A | 9/2009 |
| WO | 2004062423 | | 7/2004 |
| WO | 2005039350 | | 5/2005 |

OTHER PUBLICATIONS

European Search Report-EP Application No. 13774954.5 dated Nov. 6, 2015, citing the enumerated references listed above.
International Search Report for International Application No. PCT/KR2013/003110 dated Jul. 1, 2013.
Written Opinion for International Application No. PCT/KR2013/003110 dated Jul. 1, 2013.

* cited by examiner

*Primary Examiner* — David Walczak
(74) *Attorney, Agent, or Firm* — Cantor Colburn LLP

(57) ABSTRACT

A cosmetic composition container includes cosmetic composition storage foam; and cosmetic composition discharge adjustment foam adjacent to the storage foam.

7 Claims, No Drawings

COSMETIC COMPOSITION CONTAINER COMPRISING FOAM

TECHNICAL FIELD

The present disclosure relates to container for a cosmetic composition comprising foams.

BACKGROUND ART

In general, if it is desired to provide a cosmetic composition with fresh feeling and superior spreadability, the viscosity of the cosmetic composition is decreased. However, a cosmetic composition with low viscosity has unsatisfactory stability since separation may occur inside a container during transportation or long-term storage. For this reason, a cosmetic composition with low viscosity is provided in a tube or pump container and the user is recommended to shake the cosmetic composition before use in case separation occurs.

However, to shake is not a substantial solution since it is cumbersome and the cosmetic composition contained in the container cannot be used completely without wasting. In addition, the existing container for a cosmetic composition is disadvantageous in that control of ejection amount of the low-viscosity cosmetic composition is difficult and it is difficult to predict ejection direction.

At present, a foam for storage is used to absorb, hold and eject a content in an ink cartridge and also in a cosmetic. A foam for ejection control has a large pore size and is used to pass air or water in an automobile, air conditioner, a water purification system inside a water pipe, a cushioning part of an outdoor goods, etc. No case is reported about use of the existing foam for ejection control in a cosmetic.

In general, an applicator (e.g., a puff) is necessary to take an appropriate amount of a cosmetic composition which is absorbed in an absorber. That is to say, the absorber and the applicator are necessary and they have not been integrated as one body. The inventors of the present disclosure have researched to improve feeling of use by integrating the absorber with the applicator (puff). They differentiated use of foams as ejection control and storage and have studied materials and properties having such uses.

DISCLOSURE

Technical Problem

The present disclosure is directed to providing a container for a cosmetic composition which is capable of stably storing a low-viscosity cosmetic composition and can be used conveniently and a cosmetic comprising the container for a cosmetic composition. The present disclosure aims at introducing a foam for storage and a foam for ejection control into a cosmetic. In the present disclosure, the foam for storage may serve to absorb, impregnate and eject a content and the foam for ejection control may serve to control ejection of a low-viscosity liquid cosmetic substance.

Technical Solution

In one general aspect, the present disclosure provides a container for a cosmetic composition comprising: a foam for storage of a cosmetic composition; and a foam for ejection control of a cosmetic composition adjacent to the foam for storage of a cosmetic composition, wherein the foam for storage of a cosmetic composition has a hardness of 10-60 when measured with an Asker hardness tester type F, a cell size of 30-1000 μm and 65-130 pores per inch (ppi) and the foam for ejection control of a cosmetic composition has a hardness of 65-110 when measured with an Asker hardness tester type F, a cell size of 1100-2500 μm and 10-60 pores per inch (ppi).

In another general aspect, the present disclosure provides a cosmetic comprising: a cosmetic composition; and the container for a cosmetic composition.

Advantageous Effects

A container for a cosmetic composition according to the present disclosure can stably impregnate a low-viscosity cosmetic composition, easily eject the cosmetic composition, allows easy prediction of ejection direction thereof and allows convenient use of the cosmetic composition. A cosmetic according to the present disclosure, which comprises a low-viscosity cosmetic composition and the container for a cosmetic composition, allows use of the cosmetic composition with fresh feeling of use and superior spreadability.

BEST MODE

As used herein, a "foam" refers to rubber, vinyl, polyurethane, etc. which has been foamed and then solidified. In general, a foam has a shape of a sponge.

As used herein, a "carrier" refers to a material capable of impregnating any substance or component which may be a composition. It can also be expressed as a "medium". As used herein, "impregnating ability" refers to the ability to impregnate and hold any substance or component.

As used herein, "filling ability" refers to an ability of a urethane foam to fill a cosmetic composition. It can be expressed as the time required for a urethane foam to fill a predetermined amount of the cosmetic composition. As used herein, "discharging ability" refers to an amount of a cosmetic composition ejected from an urethane foam impregnating a cosmetic composition when the cosmetic composition is taken therefrom. It is desired that an adequate amount, which is neither too much nor too little, of the cosmetic composition is discharged.

In an aspect, the present disclosure provides a container for a cosmetic composition comprising: a foam for storage of a cosmetic composition; and a foam for ejection control of a cosmetic composition adjacent to the foam for storage of a cosmetic composition, wherein the foam for storage of a cosmetic composition has a hardness of 10-60 when measured with an Asker hardness tester type F, a cell size of 30-1000 μm and 65-130 pores per inch (ppi) and the foam for ejection control of a cosmetic composition has a hardness of 65-110 when measured with an Asker hardness tester type F, a cell size of 1100-2500 μm and 10-60 pores per inch (ppi).

The container for a cosmetic composition according to the present disclosure, which comprises a foam for storage and a foam for ejection control, is capable of stably impregnating and filling a low-viscosity cosmetic composition not containing an excessively large amount of an emulsifying agent that may deteriorate feeling of use of the cosmetic composition, is capable of easily ejecting the cosmetic composition, allows easy prediction of ejection direction thereof, and allows convenient use of the cosmetic composition.

In the present disclosure, the foam for storage serves to impregnate a liquid content for a long time and ejects it when an appropriate force is exerted and the foam for ejection control serves to ensure smooth passage and circulation of the content.

The use of the foam for ejection control in the present disclosure may allow ejection of the content with adequate amount and speed when a pressure is exerted. The foam for ejection control of a cosmetic composition may also serve as a cosmetic composition applicator by directly contacting the skin. In the present disclosure, it is desired that the foam for ejection control of a cosmetic composition has weather resistance, oil resistance, light resistance, heat resistance and anti-swelling property against, for example, a UV absorber. The weather resistance means the ability to endure the action of the natural environment such as light, wind, rain, moisture, air, etc., the light resistance means the ability to endure light and the heat resistance means the ability to high temperature. In the present disclosure, the foam for ejection control controls discharging ability such that an adequate amount of the cosmetic composition can be ejected when the cosmetic composition is taken from a urethane foam impregnating the cosmetic composition.

In the present disclosure, it is desired that the foam for storage has durability. The "durability" means the ability of a urethane foam impregnating a cosmetic composition to maintain state under a predetermined temperature for a predetermined time without being dissolved, torn or swollen.

In the present disclosure, the shape of the foam for ejection control and the foam for storage is not particularly limited. For example, they may have a cylindrical, triangular prismatic, tetragonal prismatic, rhombic prismatic, star-shaped prismatic, semicylindrical, semi-triangular prismatic or semi-tetragonal prismatic group. The shape of the foam for ejection control and the foam for storage may be identical or different.

In an exemplary embodiment of the present disclosure, the container for a cosmetic composition may be a pump-, tube-, stick- or stamp-type container. In another exemplary embodiment of the present disclosure, the pump-type container may be an airless pump-type container inside of which is in vacuum state.

In the present disclosure, the size of the foam for ejection control and the foam for storage is not particularly limited. The area of the foam for ejection control may be the same as, larger than or smaller than that of the foam for storage. Also, the horizontal or vertical length of the foam for ejection control may be the same as, larger than or smaller than that of the foam for storage.

In the present disclosure, the foam for ejection control and the foam for storage may have a shape adequate to be accommodated in the container.

In the present disclosure, the location of the foam for ejection control and the foam for storage is not particularly limited as long as the two foams come in touch with each other partly or wholly. For example, one or both sides of the foam for ejection control thereon may be located above the foam for storage. Alternatively, the foam for ejection control may be included inside the foam for storage, 5 cm or less inward from the boundary with the foam for storage. Conversely, the foam for storage may be included inside the foam for ejection control, 5 cm or less inward from the boundary with the foam for ejection control.

In an exemplary embodiment of the present disclosure, the foam may be a foam prepared from one or more selected from a group consisting of acrylonitrile-butadiene rubber (NBR), styrene-butadiene rubber (SBR), natural rubber (NR), polyvinyl chloride, polyethylene, ethylene-vinyl acetate (EVA) rubber, latex, silicone, styrene-isoprene-styrene (SIS), styrene-ethylene-butylene-styrene (SEBS), polyvinyl alcohol (PVA), nitrile rubber, butyl rubber and chloroprene rubber (Neoprene®). In another exemplary embodiment of the present disclosure, the silicone foam may be a foam prepared from a silicone-based elastomer.

In an exemplary embodiment of the present disclosure, the foam may be a filmed or flocked foam. In another exemplary embodiment of the present disclosure, the filmed foam may be one obtained by coating a film on a polymer foam such as rubber, polyvinyl or polyurethane. In general, the filmed foam has a smaller cell size than that of the foam before filming. In another exemplary embodiment of the present disclosure, the flocked foam refers to one obtained by depositing a fiber on a polymer foam. The fiber may be one or more selected from a group consisting of cotton, acryl, polyamide, nylon, polyester, silk and rayon. Specifically, cotton, acryl, polyamide, nylon, polyester, silk, cotton and acryl, cotton and rayon, nylon and polyester, and cotton, acryl and polyester may be used.

In the present disclosure, since the foam for storage is applied to an airless pump-, tube-, stick- or stamp-type container, the volume of the foam for storage increases. Accordingly, it needs to have a lower hardness and have such a property that squeezing and ejection occur well by pressure or shear.

In an exemplary embodiment of the present disclosure, the foam for storage of a cosmetic composition has a hardness of 10-60, specifically 25-60, more specifically 50-60, when measured with an Asker hardness tester type F. The hardness is a hardness before impregnating the cosmetic composition. If the hardness of the foam is lower than 10, durability of the cosmetic composition may be negatively affected. And, if it exceeds 60, the cosmetic composition may not pass and circulate smoothly.

In an exemplary embodiment of the present disclosure, the foam for ejection control of a cosmetic composition has a hardness of 65-110, specifically 65-90, more specifically 65-75, when measured with an Asker hardness tester type F. The hardness is a hardness before impregnating the cosmetic composition. If the hardness of the foam is lower than 65, the cosmetic composition may be ejected excessively. And, if it exceeds 110, the cosmetic composition may not be easily ejected.

In an exemplary embodiment of the present disclosure, the foam for storage of a cosmetic composition has 65-130, specifically 65-100, more specifically 70-80, pores per inch (ppi). As used herein, the number of pores may mean an average to number of pores per inch of a horizontal or vertical line measured according to WI-QA-14 (ASTM). If the number of pores per inch is smaller than 65, it may be difficult to control the fluidity of the low-viscosity cosmetic composition and to impregnate an adequate amount of the low-viscosity cosmetic composition. And, if the number of pores per inch exceeds 130, the low-viscosity cosmetic composition may be precipitated or separated and it may be difficult to control ejection of the composition.

In an exemplary embodiment of the present disclosure, the foam for ejection control of a cosmetic composition has 10-60, specifically 50-60 pores per inch (ppi). If the number of pores of the foam for ejection control exceeds 60 ppi, the content may reside in the foam for a long time since passage and circulation are difficult. When the foam for ejection control having 60 ppi or less pores is used, an adequate amount of the content may be ejected at an adequate rate when pressure is exerted.

In an exemplary embodiment of the present disclosure, the foam for storage of a cosmetic composition has a cell size of 30-1000 μm, specifically 80-1,000 μm, more specifically 80-500 μm. In an exemplary embodiment of the present disclosure, the "cell size" may be measured using an optical microscope (Nikon Eclipse 80i). When the foam has a cell size of the above-described range, the effect desired by the present disclosure can be achieved. Further, the cell size may be effective for maintaining stability and safety of the cosmetic composition and may be appropriate in terms of cost effectiveness.

In an exemplary embodiment of the present disclosure, the foam for ejection control of a cosmetic composition has a cell size of 1100-2500 μm, specifically 1600-2500 μm, more specifically 2000-2500 μm.

In an exemplary embodiment of the present disclosure, the foam may have an open-cell structure. If the foam has a closed-cell structure, the cosmetic composition may not be easily impregnated since air bubble is closed in the foam.

In the present disclosure, the open-cell structure refers to a network and the closed-cell structure refers to a balloon-like foam.

The container for a cosmetic composition according to the present disclosure may impregnate a cosmetic composition in the foam for storage, which is not compressed, and may eject the cosmetic composition when pressure is applied from outside as the foam for storage is compressed. The foam for ejection control of a cosmetic composition may be located toward the inlet of the container with respect to the foam for storage of a cosmetic composition so as to control the degree of ejection of the cosmetic composition from the foam for storage. That is to say, the container for a cosmetic composition according to the present disclosure may allow easy control of the degree and direction of ejection of the cosmetic composition by comprising the foam for storage and the foam for ejection control together. In another exemplary embodiment of the present disclosure, the container for a cosmetic composition may comprise two or more foams, specifically 2-5 foams.

The container for a cosmetic composition according to the present disclosure may exhibit better stability and convenience in use as compared to the existing container for a cosmetic composition when it is used for a low-viscosity cosmetic composition, specifically a cosmetic composition having a viscosity of 10,000 cps or lower, more specifically 5,000-10,000 cps or 1-5,000 cps, further more specifically 6,000-9,000 cps or 1-3,000 cps. The viscosity may be measured using a viscometer, for example, LVDV II+PRO or RVDV III ULTRA, spindle No. 63 or spindle No. 64, at 5 rpm or 12 rpm, but is not limited thereto.

The container for a cosmetic composition according to the present disclosure may stably store a fluid-type cosmetic composition and allow convenient use thereof. In another exemplary embodiment of the present disclosure, the fluid-type cosmetic composition comprises any cosmetic composition existing in fluid state. Specifically, it comprises lotion, essence, liquid makeup base, liquid foundation, liquid blemish balm (BB) or liquid sunscreen, but is not limited thereto.

In another aspect, the present disclosure provides a cosmetic comprising: a is cosmetic composition; and the container for a cosmetic composition. The cosmetic, which comprises a low-viscosity cosmetic composition and a container for a cosmetic composition capable of stably impregnating and adequately ejecting the composition, provides fresh feeling of use and superior spreadability and allows convenient use of the cosmetic composition.

Hereinafter, the present disclosure will be described in detail through a preparation example, examples, comparative examples and test examples. However, the following preparation example, examples, comparative examples and test examples are for illustrative purposes only and it will be apparent to those of ordinary skill in the art that the scope of the present disclosure is not limited by the examples.

PREPARATION EXAMPLE

Preparation of Cosmetic Composition

A cosmetic composition having a viscosity of 5,000-10,000 cps was prepared as described in Table 1. Specifically, after dissolving oily components, a pigment was added and dispersed. Then, separately mixed aqueous components were added thereto to prepare a cosmetic composition having a viscosity of 5,000-10,000 cps.

TABLE 1

| | | Components | wt % |
|---|---|---|---|
| Oily components | Oily components | Ozokerite | 1.0 |
| | | Dicaprylyl carbonate | 10.00 |
| | Anti-UV agent | Octyl methoxycinnamate | 7.000 |
| | Thickener | Disteardimonium hectorite | 1.50 |
| | Oily component | Decamethylcyclopentasiloxane | 16.00 |
| | Emulsifying agent | Sorbitan sesquioleate | 2.000 |
| | | Lauryl PEG/PPG-18/18 methicone | 1.500 |
| | Pigments | Poly(methyl methacrylate) | 5.00 |
| | | Titanium dioxide/iron oxide | 7.00 |
| Aqueous components | | Water | To 100 |
| | Emulsification stabilizer | Salt | 1.00 |
| | Humectant | Glycerine | 8.00 |
| | | Flavor | 0.2 |
| | | Total | 100 |

Test Example 1

Evaluation of Containers for a Cosmetic Composition

The cosmetic composition prepared in Preparation Example was held in various containers comprising foams and convenience of use, composition stability, filling ability, impregnating ability and discharging ability were evaluated for the containers. As described in Table 4, pump-, tube-, stick- and stamp-type containers were comprising both a foam for storage and a foam for ejection control were used in Examples 1-4. A pump-type container not comprising a foam was used in Comparative Example 1 and a Comparative Example 1 comprising only a foam for storage was used in Comparative Example 2. In Examples 1-4 and Comparative Example 2, the cosmetic composition was impregnated in the foam for storage. The physical properties of the foam for storage comprised in each container are described in Table 2 and the physical properties of the foam for ejection control are described in Table 3.

TABLE 2

| Physical properties of foam for storage | | |
|---|---|---|
| Asker type F hardness | Number of pores per inch (ppi) | Cell size |
| 45 | 80 | 800 μm |

TABLE 3

| Physical properties of foam for ejection control | | |
|---|---|---|
| Asker type F hardness | Number of pores per inch (ppi) | Cell size |
| 80 | 45 | 1,500 μm |

The evaluation result is given in Table 4. Number of pores per inch was measured by counting and averaging the number of pores per inch of a horizontal or vertical line according to WI-QA-14 (ASTM) and cell size was measured using an optical microscope (Nikon Eclipse 80i). Convenience of use was evaluated by 20 users who used the cosmetic. Stability was evaluated by observing whether separation occurs after storing at 40° C. for a month. Filling ability was measured as the time required to absorb 30 g of the cosmetic composition. Impregnating ability was evaluated by observing whether separation from the foam for storage occurs during storing at 40° C. Discharging ability was evaluated by observing whether problems occur during use of the container.

TABLE 4

| | Comp. Ex. 1 | Comp. Ex. 2 | Ex. 1 | Ex. 2 | Ex. 3 | Ex. 4 |
|---|---|---|---|---|---|---|
| Foams | — | Foam for storage | Foam for storage + foam for ejection control | Foam for storage + foam for ejection control | Foam for storage + foam for ejection control | Foam for storage + foam for ejection control |
| Container type | Pump | Pump | Pump | Tube | Stick | Stamp |
| Convenience of use | X | ○ | ○ | ○ | ○ | ◎ |
| Stability | X | ○ | ○ | ○ | ○ | ○ |
| Filling ability | — | ○ | ○ | ○ | ○ | ○ |
| Impregnating ability | — | ○ | ○ | ○ | ○ | ○ |
| Discharging ability | — | Δ | ◎ | ◎ | ◎ | ○ |

*◎: very good, ○: good, Δ: moderate, X: poor.

As seen from above, Examples 1-4 were superior in convenience of use, composition stability, filling ability, impregnating ability and discharging ability as compared to Comparative Examples. In particular, the containers of Examples 1-4 showed remarkably superior discharging ability as compared to Comparative Examples due to the presence of the foam for ejection control. Accordingly, it can be seen that the container for a cosmetic composition according to the present disclosure, which comprises a foam for storage and a foam for ejection control unlike the existing container for a cosmetic composition, is capable of stably impregnating and filling a low-viscosity cosmetic composition, can easily eject the cosmetic composition, allows easy prediction of ejection direction thereof, and allows convenient use.

Test Example 2

A cosmetic composition having a viscosity of 5,000-10,000 cps was filled in a is general tube container and a container comprising a foam for storage and a foam for ejection control. The degree of ejection was evaluated 15 days later. A 50-mL tube container with a diameter of 3 Φ was used. A foam for storage having an Asker type F hardness of 45 and 80 ppi and a foam for ejection control having an Asker type F hardness of 80 and 45 ppi were used. Amount of ejection from the tube was measured while applying a pressure of 30 Pa to each of the foam for storage and the foam for ejection control. The result is given in Table 5 and Table 6. An ejection amount of 0.15-0.25 is adequate when the tube is pressed with a pressure of 30 Pa. The result for Comparative Examples 3-5 and Example 5 is shown in Table 7.

TABLE 5

| Foam for storage | | | | |
|---|---|---|---|---|
| Hardness | 10 | 30 | 70 | 90 |
| Ejection amount (g) at 30 Pa | 0.35 | 0.25 | 0.15 | 0.05 |

TABLE 6

| Foam for ejection control | | | |
|---|---|---|---|
| ppi | 30 | 60 | 90 |
| Ejection amount (g) at 30 Pa | 0.40 | 0.20 | 0.08 |

TABLE 7

| | Comp. Ex. 3 | Comp. Ex. 4 | Comp. Ex. 5 | Ex. 5 |
|---|---|---|---|---|
| Foam for storage | — | Hardness 45, 80 ppi | — | Hardness 45, 80 ppi |
| Foam for ejection control | — | — | Hardness 80, 45 ppi | Hardness 80, 45 ppi |
| Ejection amount (g) at 30 Pa | Ejection control is difficult due to low viscosity, 0.6 g | 0.4 g | Separation of content observed | 0.2 g |

When neither the foam for storage nor the foam for ejection control was used (Comparative Example 3), separation of the low-viscosity content was observed. It was difficult to control the ejection of the content and the content was ejected continuously. When only the foam for storage was used (Comparative Example 4), the content was not ejected when a pressure of 30 Pa was applied. When only the foam for ejection control was used (Comparative Example 5), separation of the low-viscosity content was observed. When both the foam for storage and the foam for ejection control were used (Example 5), an adequate amount of the content was ejected.

The invention claimed is:

1. A cosmetic comprising a cosmetic composition and a container for the cosmetic composition, wherein the container comprising:

a foam for storage of the cosmetic composition; and a foam for ejection control of the cosmetic composition adjacent to the foam for storage of the cosmetic composition, and located toward an inlet of the container with respect to the foam for storage of the cosmetic composition, wherein the foam for storage is impregnated with the cosmetic composition for a long time, and ejects the cosmetic composition to the foam for ejection control, wherein the foam for storage of a cosmetic composition has a hardness of 10-60 when measured with an Asker hardness tester type F, a cell size of 30-1000 μm and 65-130 pores per inch (ppi) and the foam for ejection control of a cosmetic composition has a hardness of 65-110 when measured with an Asker hardness tester type F, a cell size of 1100-2500 μm and 10-60 pores per inch (ppi).

2. The cosmetic according to claim 1, wherein one or more of the foam for storage of a cosmetic composition and the foam for ejection control of a cosmetic composition comprises a foam prepared from one or more selected from a group consisting of acrylonitrile-butadiene rubber (NBR), styrene-butadiene rubber (SBR), natural rubber (NR), polyvinyl chloride, polyethylene, ethylene-vinyl acetate (EVA) rubber, latex, silicone, styrene-isoprene-styrene (SIS), styrene-ethylene-butylene-styrene (SEBS), polyvinyl alcohol (PVA), nitrile rubber, butyl rubber and chloroprene rubber.

3. The cosmetic according to claim 1, wherein the foam for storage of at least one of the cosmetic composition and the foam for ejection control of the cosmetic composition comprises a filmed foam or a flocked foam.

4. The cosmetic according to claim 3, wherein the flocked foam comprises a foam flocked with one or more selected from a group consisting of cotton, acryl, polyamide, nylon, polyester, silk and rayon.

5. The cosmetic according to claim 1, wherein the cosmetic composition has a viscosity of 10,000 cps or lower.

6. The cosmetic according to claim 1, wherein the cosmetic composition is a fluid.

7. The cosmetic according to claim 1, wherein the container for a cosmetic composition comprises a pump-, tube-, stick- or stamp-type container.

* * * * *